US010935250B2

(12) United States Patent
Querejeta Andueza et al.

(10) Patent No.: US 10,935,250 B2
(45) Date of Patent: Mar. 2, 2021

(54) GAS COOKING APPLIANCE

(71) Applicant: Copreci, S. Coop., Aretxabaleta (ES)

(72) Inventors: Félix Querejeta Andueza, Hendaye (FR); Imanol Arriola-Bengoa Unzueta, Erentxun (ES); Iñigo Peñagaricano Badiola, Urretxu (ES); Iñaki Ayastuy Aretxaga, Bergara (ES); José Ignacio Mugica Odriozola, Bergara (ES)

(73) Assignee: COPRECI, S. COOP., Aretxabaleta (ES)

( * ) Notice: Subject to any disclaimer, the term of this patent is extended or adjusted under 35 U.S.C. 154(b) by 108 days.

(21) Appl. No.: 16/448,687

(22) Filed: Jun. 21, 2019

(65) Prior Publication Data

US 2019/0309954 A1 Oct. 10, 2019

Related U.S. Application Data

(63) Continuation of application No. PCT/EP2017/083394, filed on Dec. 18, 2017.

(30) Foreign Application Priority Data

Dec. 21, 2016 (EP) ..... 16382638

(51) Int. Cl.
*F24C 3/12* (2006.01)
*F23N 1/00* (2006.01)
(Continued)

(52) U.S. Cl.
CPC ..... *F24C 3/126* (2013.01); *F23N 1/002* (2013.01); *F23N 1/005* (2013.01); *F23N 5/102* (2013.01);
(Continued)

(58) Field of Classification Search
CPC .. F24C 3/126; F24C 3/12; F23N 5/102; F23N 1/002; F23N 5/105; F23N 1/005;
(Continued)

(56) References Cited

U.S. PATENT DOCUMENTS 3,297,252 A * 1/1967 King ..... F23N 5/065 236/46 R
5,575,638 A 11/1996 Witham et al.
(Continued)

FOREIGN PATENT DOCUMENTS

EP 0802374 A1 10/1997
EP 1671066 B1 12/2009
(Continued)

OTHER PUBLICATIONS

International Search Report and Written Opinion in corresponding International Application No. PCT/EP2017/083394, dated Feb. 16, 2018, 14 pages.
(Continued)

*Primary Examiner* — David J Laux
(74) *Attorney, Agent, or Firm* — Edell, Shapiro & Finnan, LLC

(57) ABSTRACT

According to one embodiment a gas cooking appliance is provided that includes at least one burner and a manual regulating valve for each burner. The manual regulating valve includes a manual actuator movable in a range of actuation (A) to vary a gas flow rate (Q) therethrough. At least one electromagnetic valve fluidly communicates the manual regulating valve and the burner. A control unit controls the electromagnetic valve. At least one temperature sensor is electrically connected to the control unit to measure a temperature related to a cooking process. A cooking program selector is electrically connected to the control unit and mechanically coupled to the manual actuator, such that each cooking program is associated with a gas flow rate, the program selector including at least one cooking program with temperature regulation.

22 Claims, 10 Drawing Sheets

(51) Int. Cl.
*F23N 5/20* (2006.01)
*F23N 5/10* (2006.01)

(52) U.S. Cl.
CPC ..... *F23N 5/105* (2013.01); *F23N 5/203* (2013.01); *F24C 3/12* (2013.01); *F23N 2223/38* (2020.01); *F23N 2225/08* (2020.01); *F23N 2235/16* (2020.01); *F23N 2237/02* (2020.01); *F23N 2241/08* (2020.01)

(58) Field of Classification Search
CPC .. F23N 5/203; F23N 2225/08; F23N 2235/16; F23N 2241/08
See application file for complete search history.

(56) References Cited

U.S. PATENT DOCUMENTS

| | | | |
|---|---|---|---|
| 5,816,235 | A | 10/1998 | Kim et al. |
| 7,255,100 | B2 | 8/2007 | Repper et al. |
| 8,001,957 | B2 | 8/2011 | Clauss et al. |
| 2016/0313002 | A1 | 10/2016 | Johncock et al. |
| 2019/0338956 | A1* | 11/2019 | Huang ..... F23N 1/005 |

FOREIGN PATENT DOCUMENTS

| | | | |
|---|---|---|---|
| EP | 2703723 | A1 | 3/2014 |
| EP | 2789280 | A1 | 10/2014 |
| FR | 2308868 | A1 | 11/1976 |
| JP | 2005009699 | A | 1/2005 |
| KR | 20150099080 | A | 8/2015 |
| WO | 2007100611 | A2 | 9/2007 |
| WO | 2009040115 | A2 | 4/2009 |
| WO | 2009040243 | A2 | 4/2009 |
| WO | 2014102384 | A1 | 7/2014 |

OTHER PUBLICATIONS

Extended European Search Report in corresponding European Application No. 16382638.1, dated Jun. 22, 2017, 7 pages.

* cited by examiner

GAS COOKING APPLIANCE

CROSS-REFERENCE TO RELATED APPLICATIONS

This application relates to and claims the benefit and priority to International Application No. PCT/EP2017/083394, filed Dec. 18, 2017, which relates to and claims the benefit and priority to European Application No. EP16382638.1, filed Dec. 21, 2016.

TECHNICAL FIELD

The present invention relates to gas cooking appliances.

BACKGROUND

Gas cooking appliances are known to comprise a gas line feeding at least one manual gas flow regulating valve, which can be a gas cock, and at least one gas burner fed by a gas flow regulated by the regulating valve.

EP2789280A1 discloses a gas cooking appliance in which each manual regulating valve is in direct fluid communication with its respective gas burner. The gas cooking appliance further comprises one main cut-off valve between the gas supply and the gas line feeding the manual regulating valves, a control unit for controlling the cut-off valve and a manual actuator. The manual actuator comprises a first position allowing the passage of gas through the cut-off valve, and a second position allowing the user to control the operation of the gas cooking appliance remotely by means of a remote control unit, activating the control unit and putting said control unit in contact with the remote control unit by means of exchanging instructions. The user can remotely close the cut-off valve for turning the gas cooking appliance off. After closing the cut-off valve, it is necessary to move the manual actuator back to the first position in order to open the cut-off valve and turn the gas cooking appliance on again. After turning on the gas cooking appliance, the manual actuator has to be moved to the second position for activating the control unit.

In order to protect a vessel arranged on the gas burner which has been turned on from overheating, and to control the temperature of a product being cooked, the gas cooking appliances comprise thermal safety elements connected to the control unit, detecting the temperature of the vessel and/or the cooked product. To control gas flow feeding the gas burner from the regulating valve, these gas cooking appliances usually comprise an electromagnetic valve fluidly arranged between the regulating valve and the gas burner.

KR2015099080A describes a gas cooking appliance comprising at least one gas burner, a regulating valve for each gas burner for regulating the gas flow reaching the burner from a gas line, said regulating valve comprising an actuator movable in a range of actuation, the gas flow rate being changed when the manual actuator is moved in the range of actuation, an ON-OFF type electromagnetic gas valve fluidly communicating the regulating valve and the burner, a control unit for controlling the electromagnetic valve, and a temperature sensor electrically connected to the control unit to measure a temperature related to a cooking process in the burner. With this configuration, the gas cooking appliance protects the vessel and/or cooked product from excessive temperatures.

SUMMARY

According to one embodiment a gas cooking appliance is provided that comprises at least one gas burner, a manual regulating valve for each gas burner for regulating the gas flow reaching the burner from a gas line, said regulating valve comprising a manual actuator movable in a range of actuation, the gas flow rate being changed through the regulating valve when the actuator is moved in the range of actuation, an ON-OFF type electromagnetic gas valve fluidly communicating the regulating valve and the burner, a control unit for controlling the electromagnetic valve, and a temperature sensor electrically connected to the control unit to measure a temperature related to a cooking process in the burner.

The gas cooking appliance comprises a cooking program selector which is electrically connected to the control unit and mechanically coupled to the actuator, such that when the actuator is moved in the range of actuation, each selected cooking program is associated with a specific gas flow rate supplied by the regulating valve, the program selector comprising at least one cooking program with temperature regulation for carrying out the cooking process. The control unit acts on the electromagnetic valve depending on the selected cooking program with temperature regulation.

Gas cooking appliances of the prior art allow regulating the temperature of cooking processes only for a specific gas flow rate supplied by the regulating valve. The gas cooking appliance described in KR2015099080A cuts off gas flow when a specific temperature is reached for safety purposes and can even regulate the cooking temperature at high temperatures with a high gas flow to the gas burner, but a cooking program in any range of gas flow rate supplied by the regulating valve cannot be selected.

The gas cooking appliances disclosed herein allows selecting a cooking program for different gas flow rates supplied by the regulating valve, such that said regulating valve can be designed to supply the desired gas flow rate to the gas burner at any point of the range of actuation of the actuator, and a cooking program with temperature regulation can be defined at any point of said range of actuation since the program selector which allows doing it is electrically connected to the control unit, the cooking program with temperature regulation being synchronized with a desired gas flow rate for said cooking program.

These and other advantages and features will become evident in view of the drawings and detailed description.

DETAILED DESCRIPTION

Figure 1:
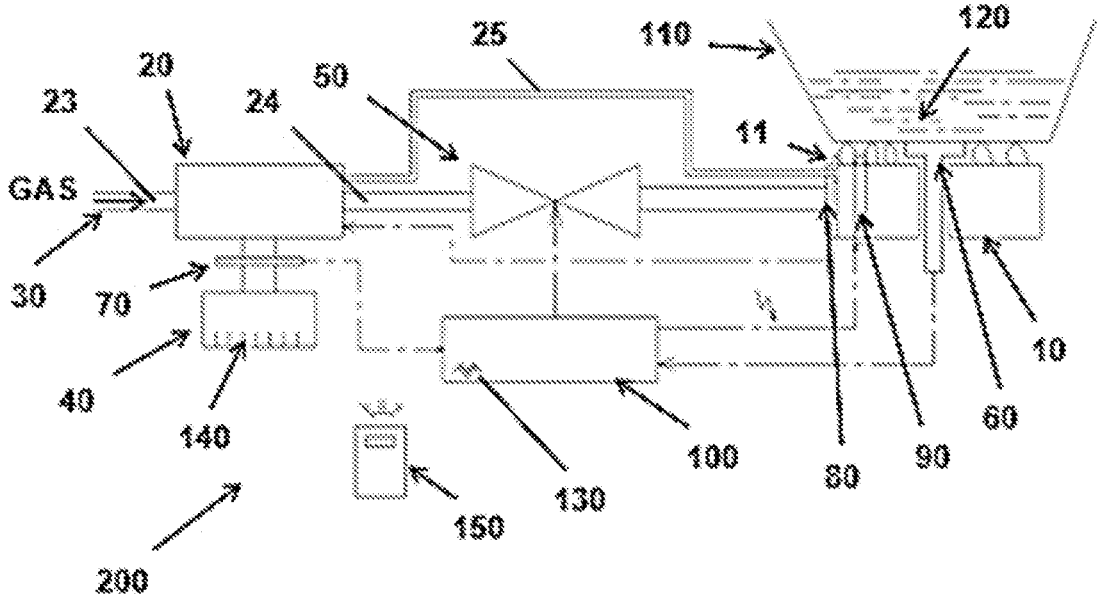
FIG. 1 shows a general outline of a gas cooking appliance according to one embodiment.
Figure 2:
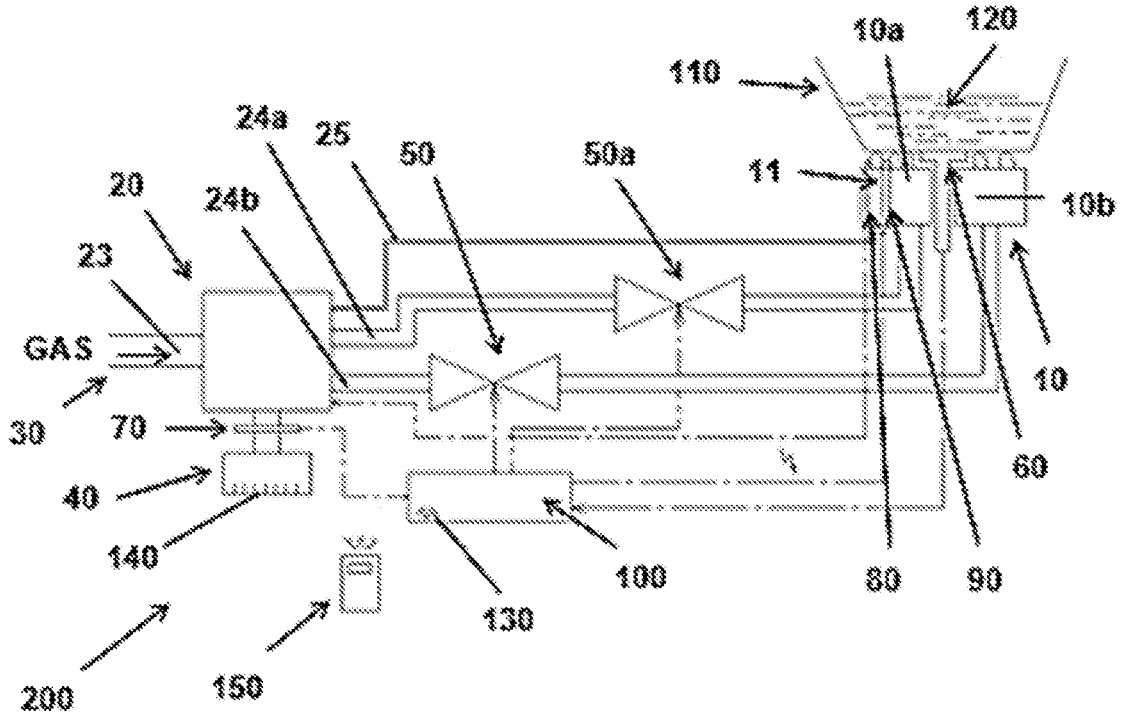
FIG. 2 shows a general outline of a gas cooking appliance according to a second embodiment.
Figure 3:
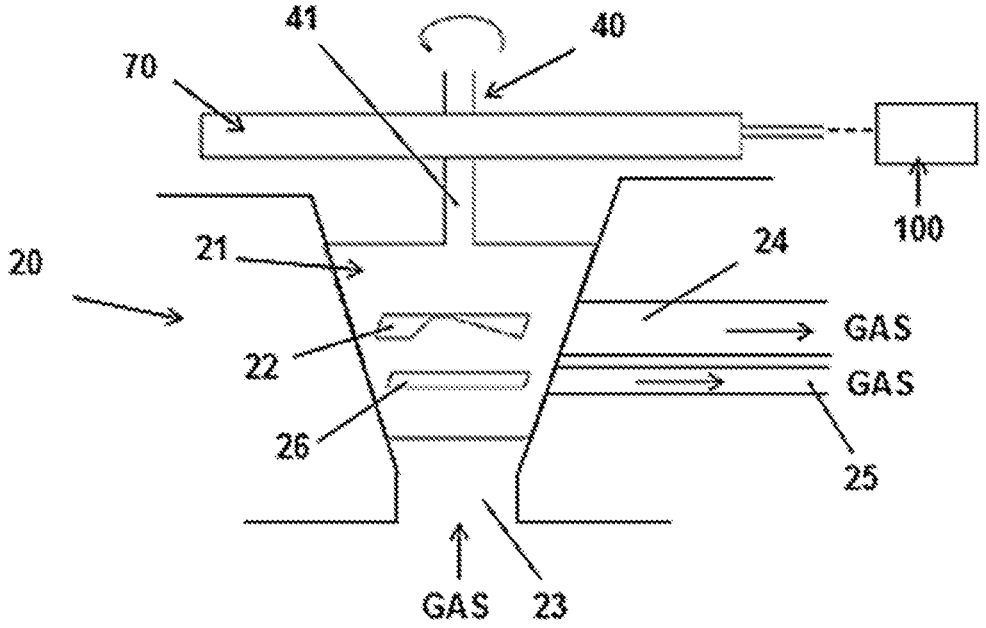
FIG. 3 shows a partial outline of the regulating valve of the gas cooking appliance of FIG. 1, with a program selector coupled thereto, and a regulator element comprising a regulating channel of a gas burner, and a pilot channel of a pilot burner of the gas cooking appliance.
Figure 4:
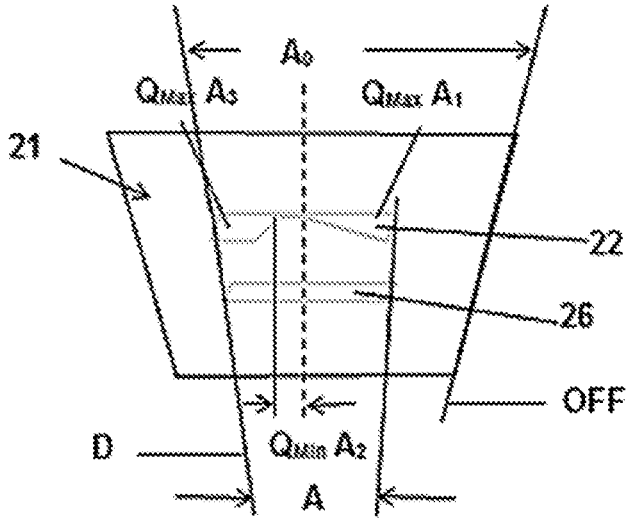
FIG. 4 shows a developmental view of the regulator element of the regulating valve of FIG. 3.
Figure 8:
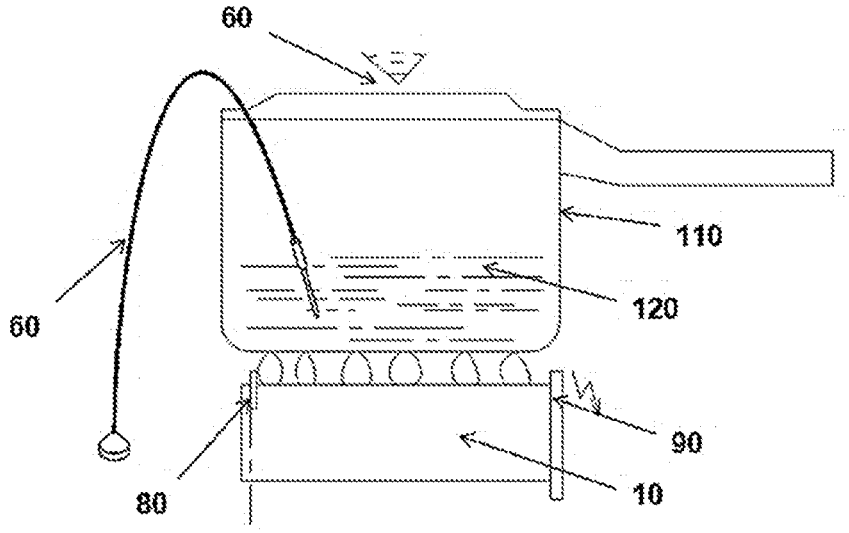
FIG. 8 shows a vessel used for cooking arranged on a gas burner with the flame ON with a product to be cooked therein, with a temperature sensor arranged in contact with the vessel, and another temperature sensor arranged in contact with the product to be cooked.

FIG. 1 shows a general outline of an embodiment of a gas cooking appliance 200 which, in this case, is a gas cooker but can be any other gas cooking appliance. FIG. 2 shows a general outline of a second embodiment of a gas cooking appliance 200. FIG. 3 shows a partial outline of a regulating valve 20 of the gas cooking appliance 200 of FIG. 1 with a program selector 70 coupled thereto, and a regulator element 21 comprising a regulating channel 22 of a gas burner 10, and a pilot channel 26 of a pilot burner 11 of the gas cooking appliance 200. FIG. 4 shows a plan view of the regulator element 21 of the regulating valve 20 of FIG. 3. FIG. 8 shows a vessel 110 used for cooking arranged on the gas burner 10 with the flame on, with a product 120 to be cooked therein, with a temperature sensor 60 arranged in contact with the vessel 110 and another temperature sensor 60 arranged in contact with the product 120 to be cooked.

The first embodiment of the gas appliance 200 shown in FIG. 1 comprises a gas burner 10 that has been turned on and has a flame, with a vessel 110 used for cooking on top. The gas cooking appliance 200 also comprises a gas valve 20 for said burner 10. The gas valve 20 is fluidly communicated with a gas inlet line 30 feeding said gas valve 20 in an inlet 23 and comprises a gas outlet 24 fluidly connected with the gas burner 10 which allows feeding gas thereto. The gas valve 20 comprises a manual actuator 40 which is suitable for acting on the regulating valve 20 for regulating gas flow to the gas burner 10.

The gas valve 20 comprises a regulator element 21 arranged in the gas flow going through said regulating valve 20, in the interior thereof, in a cavity of the body of the regulating valve 20. The manual actuator 40 is mechanically coupled to said regulator element 21. In the embodiment of the gas cooking appliance that is shown, the regulator element 21 has a frustoconical shape and can turn about its shaft when it is actuated by the manual actuator 40. The manual actuator 40, and therefore the regulator element 21, can turn a maximum angle of rotation A0. The regulator element 21 therefore moves angularly when it is actuated by the manual actuator 40 within the maximum angle of rotation A0, which in this embodiment is 270°, between an initial OFF position corresponding to an angular position of 0°, in which the regulating valve 20 is closed and does not supply any gas flow to the burner 10, and a final position D corresponding to an angular position of 270°, in which the regulating valve 20 supplies a maximum flow in this embodiment.

The regulator element 21 comprises in this embodiment a regulating channel 22 communicating the inlet 23 and the outlet 24 of the regulating valve 20 when the regulator element 21 is turned by the manual actuator 40 to specific angular positions. The regulator element 21 comprises a body with a hollow interior, the inlet 23 of the regulating valve 20 being communicated with said hollow interior and the regulating channel 22 fluidly communicating the hollow interior of the body of the regulator element 21 with the outside of said body. When the regulator element 21 turns to regulate gas flow to the gas burner 10, the regulating channel 22 is aligned with the outlet 24 of the regulating valve 20 in a specific angular position, and fluid communication takes place between the inlet 23 and the outlet 24 of the regulating valve 20.

The range of angular positions in which gas is supplied to the outlet 24 is referred to as range of actuation, and in this embodiment of the gas cooking appliance 200 it is an angle of rotation A. This angle of rotation A is smaller than the maximum angle of rotation A0 of the regulator element 21. In the embodiment of the regulator element 21 shown in FIG. 4, gas flow supply to the outlet 24 starts in an angular position A1 corresponding to a maximum gas flow QMax, the position A1 being 90°. As the manual actuator 40 is turned further, the gas flow progressively decreases to an intermediate gas flow rate, until an angular path A2 corresponding to a minimum gas flow QMin, the angular path A2 being between 180° and 220°, for example. The regulator element can be turned further up to 270°, starting at the end of the angular path A2 with a rapid increase of gas flow to the maximum gas flow QMax and maintaining it until the final position D.

The description of the regulator element 21 of the regulating valve 20 is logically a mere embodiment. The regulating channel 22 can be designed in any shape such that the gas flow rate supplied to the gas burner 10 in each position of the range of actuation A can be different from one regulating valve 20 to another. Similarly, the regulator element 21 does not have to have a frustoconical shape, nor does it have to be rotary. In another embodiment, the regulator element 21 can have a shape such that gas flow to the burner 10 is regulated by sliding and not by turning, and the manual actuator 40 acts on the regulating valve 20 in a range of actuation A which is a distance and not an angle.

The embodiment of the gas cooking appliance 200 that is shown comprises a pilot burner 11 which is arranged close to the gas burner 10. The regulating valve 20 supplies a gas flow to the pilot burner 11. The gas cooking appliance 200 comprises in this embodiment a gas line 25 fluidly connecting said regulating valve 20 and the pilot burner 11. The regulator element 21 also comprises in this embodiment a pilot channel 26 which, like the regulating channel 22, communicates with the hollow interior of the regulator element 21. In this embodiment, the range of actuation in which gas is supplied to the pilot burner 11 is the same range of actuation A as that of the regulator element 21, gas being supplied from the angular position A1 until the final position D, such that the inlet 23 of the regulating valve 20 is in fluid communication with the gas line 25 in the range of actuation A. In this embodiment of the pilot channel 26, said pilot channel 26 has a shape such that gas supply to the pilot burner 11 is constant.

The gas cooking appliance 200 also comprises an electromagnetic valve 50. This electromagnetic valve 50 is an ON-OFF type gas valve, i.e., it has a gas inlet line and a gas outlet line communicated through a gas passage and a closure member (not shown in the drawings), such that by means of electrical signals said closure member is either in an OFF position, closing the gas passage, or in an ON position, leaving the gas passage open. In this embodiment of the gas cooking appliance 200, the electromagnetic valve 50 is a normally open solenoid-type valve, i.e., the closure member transitions from the ON position to the OFF position when the electromagnetic valve 50 receives an electrical signal, and said electrical signal is maintained. If there is no electric power, the closure member transitions to the ON position with the gas passage open and remains in this position at all times. This allows being able to manually operate said appliance by acting on the regulating valve 20 if the gas cooking appliance 200 is left without electric power. Other types of electromagnetic valves 50 can also be used, such as for example a normally closed solenoid-type valve, or a bistable-type valve the closure member of which transitions from the ON position to the OFF position or vice versa by means of electrical pulses, without having to maintain the electrical signal. The electromagnetic valve 50 is arranged between the regulating valve 20 and the gas burner 10, allowing their fluid communication.

The gas cooking appliance 200 comprises a control unit 100, said control unit 100 electrically controlling the electromagnetic valve 50 by sending electrical signals for transitioning said valve from the ON position to the OFF position and keeping it in said position. Furthermore, the gas cooking appliance 200 also comprises a temperature sensor 60 arranged in contact with the vessel 110, specifically in contact with the outer lower base of the vessel 110 which is arranged on the burner 10 that is turned on. In other embodiments of the gas cooking appliance 200, said gas cooking appliance 200 comprises, as shown in FIG. 8, a temperature sensor 60 arranged in contact with the vessel 110, specifically in contact with the lid of the vessel 110, and another temperature sensor 60 arranged in contact with the product 120 to be cooked. Each of the temperature sensors 60 is electrically connected to the control unit 100, such that said sensors send electrical signals to the control unit 100 associated with the temperatures that are being sensed during the established cooking process. These temperature sensors 60 can be of different types, with them normally being thermistors. In the embodiment of the gas cooking appliance 200 shown in FIG. 8, the temperature sensor 60 arranged in the lid of the vessel 110 is a sensor with Bluetooth LE (Bluetooth Low Energy) technology which in this example senses the temperature in the lid and send the signals indicating the temperature to the control unit 100 by Bluetooth. The temperature sensor 60 which is in contact with the product 120 to be cooked is a probe which is placed in contact with said product 120, and sends the signals indicating the sensed temperature to the control unit 100 by means of a wire or wirelessly.

The gas cooking appliance 200 comprises a cooking program selector 70. This program selector 70 is electrically connected to the control unit 100 and mechanically coupled to the manual actuator 40. The mechanical coupling takes place between the program selector 70 and a shaft 41 comprised in the manual actuator 40, said shaft 41 in turn being coupled to the regulator element 21 such that the actuation of the manual actuator 40 in its range of actuation A results in an actuation of the regulator element 21 of the regulating valve 20 and of the program selector 70. Therefore, in this embodiment of the gas appliance 200, turning the manual actuator 40 results into turning the regulator element 21 and into turning at least one component of the program selector 70.

The program selector 70 basically comprises a box-shaped housing (not shown in the drawings) and a rotary element therein mechanically coupled to the shaft 41 of the manual actuator 40 with a conductive end, and a board with different electric circuits, by way of tracks, electrically connected with the control unit 100, said electric circuits corresponding to different cooking programs defined in the gas cooking appliance 200, these cooking programs being temperature-regulated programs. Therefore, when the shaft 41 turns, the rotary element turns, and the conductive end electrically contacts one of the circuits of the board of the program selector 70. Therefore, depending on how the board with electric circuits of the program selector 70 is designed, the conductive end will electrically contact one of said circuits, electrical signals which will be sent to the control unit 100 being generated. The board of the program selector 70 is designed such that the electric circuits are arranged within the range of actuation A of the manual actuator 40. Therefore, when acting on the manual actuator 40, electrical connection between the conductive end of the rotary element and one of the electric circuits of the board of the program selector 70 is made within the range of actuation A, said electrical connection coinciding with an angular position in said range of actuation A, the selected cooking program being synchronized with a specific gas flow rate supplied by the regulating valve 20 to the electromagnetic valve 50.

In the gas cooking appliance 200 shown in this embodiment, when the control unit sends an electrical closing signal at the OFF position to the electromagnetic valve 50, there is no gas flow from the regulating valve 20 to the gas burner 10. Unlike other electromagnetic valves of the prior art, the electromagnetic valve 50 does not comprise a bypass or gas pathway communicating the regulating valve 20 with the burner 10. This therefore allows the burner 10 to have the flame off and the temperature in the vessel 110 and/or in the product 120 to be cooked to drop. In order to turn the burner 10 on again when the control unit 100 stops sending the electrical signal to the electromagnetic valve 50, and this valve transitions to the open ON position, allowing gas flow to the burner 10, the gas cooking appliance 200 of this embodiment comprises the pilot burner 11 which the user turns on when they start to operate said gas cooking appliance 200.

Figure 5:
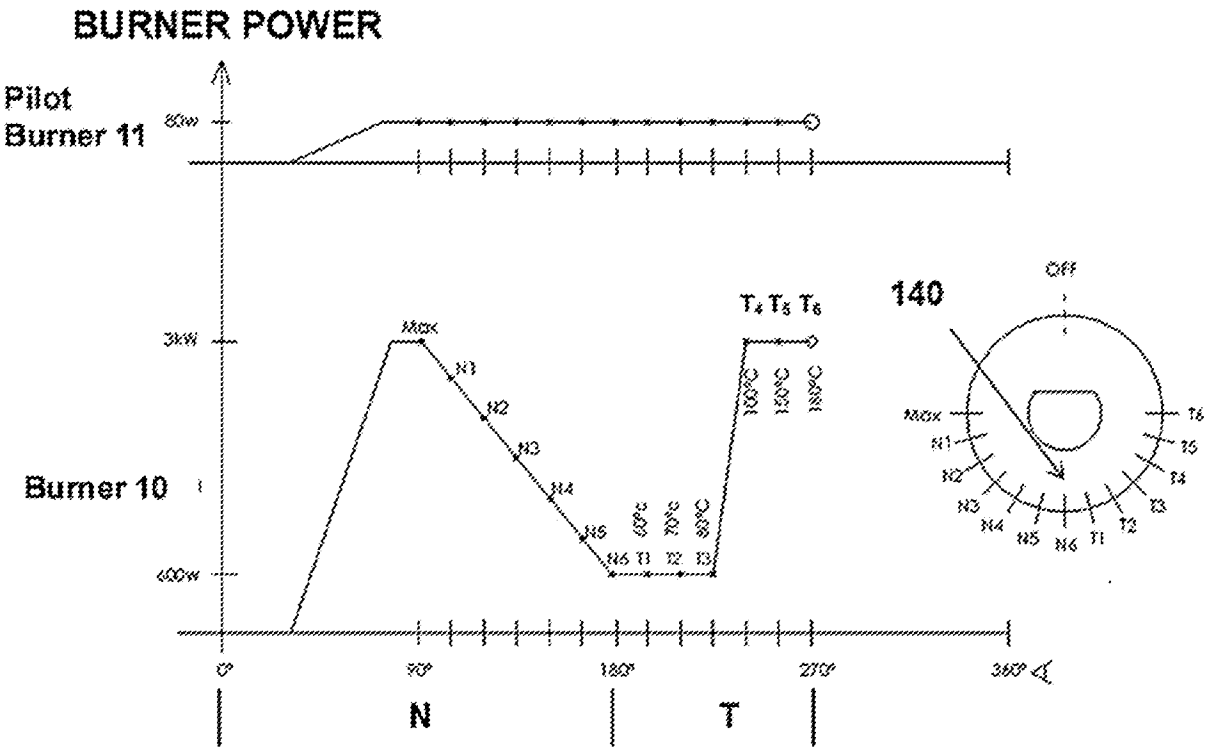
FIG. 5 shows a diagram linking the power of the gas burner and the pilot burner of the gas cooking appliance of FIG. 1 with the angle of rotation of the regulator element, in one embodiment of the regulator element of the regulating valve, and it shows visual indicators indicating to the user the cooking programs they can select with the program selector.
Figure 6:
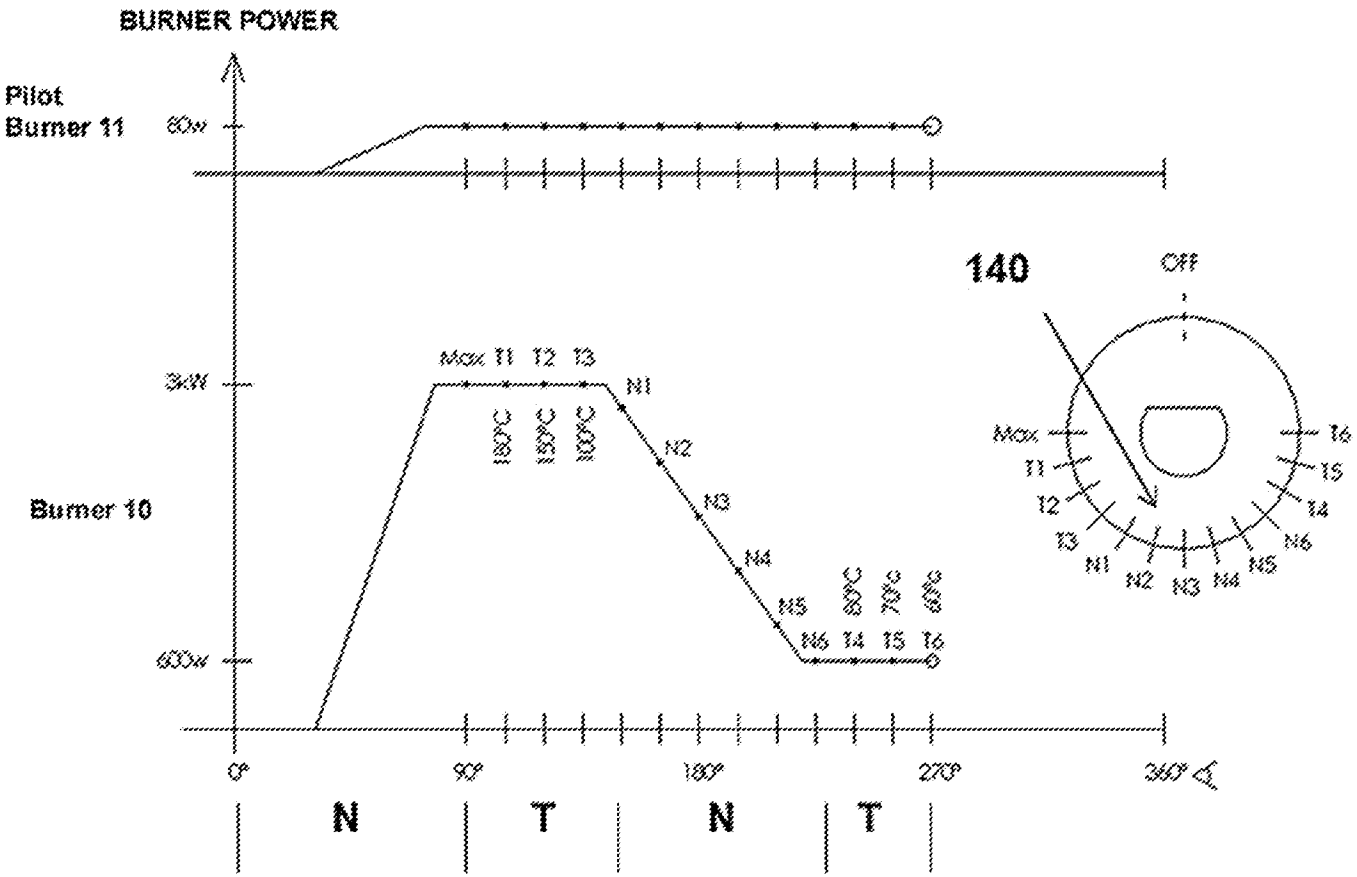
FIG. 6 shows a diagram linking the power of the gas burner and the pilot burner of the gas cooking appliance of FIG. 1 with the angle of rotation of the regulator element, in a second embodiment of the regulator element of the regulating valve, and it shows visual indicators indicating to the user the cooking programs they can select with the program selector in this second embodiment.

FIG. 5 shows a diagram linking the power of the gas burner 10 and the pilot burner 11 of the gas cooking appliance 200 of FIG. 1 with the maximum angle of rotation A0 of 270° of the regulator element 21 of the regulating valve 20, and it shows visual indicators 140 indicating to the user the cooking programs N, T they can select with the program selector 70. Furthermore, FIG. 6 shows a diagram linking the power of the gas burner 10 and the pilot burner 11 of the gas cooking appliance 200 of FIG. 1 with the maximum angle of rotation A0 of 270° of the regulator element 21 in a second embodiment of the regulator element 21 of the regulating valve 20, and it shows visual indicators 140 indicating to the user the cooking programs N, T they can select with the program selector 70 in this second embodiment.

The program selector 70 comprises cooking programs N without temperature regulation which can be selected by the user with the help of the visual indicators 140 arranged in the manual actuator 40 in this embodiment of the gas cooking appliance 200. These cooking programs N correspond with angular positions of the program selector 70, in the angle of rotation A, and therefore with angular positions of the board comprising the different circuits that do not correspond with the position of circuits corresponding to cooking programs T with temperature regulation. These angular positions of cooking programs N correspond to specific gas flow rates supplied by the regulating valve 20 through its regulator element 21. In these cooking programs N, the control unit 100 is not electrically connected with the electromagnetic valve 50, and therefore does not control it, such that said electromagnetic valve 50 is open and gas flow to the burner 10 is what corresponds to that position of the selected cooking program N, and therefore to the corresponding position of the regulator element 21.

The program selector 70 also comprises cooking programs T with temperature regulation which can be selected by the user with the help of the visual indicators 140. These cooking programs T correspond with angular positions of the program selector 70, in the angle of rotation A, and therefore with angular positions of the board comprising the different circuits corresponding with the position of circuits corresponding to cooking programs T with temperature regulation. These angular positions of the cooking programs T correspond with specific gas flow rates supplied by the regulating valve 20 through its regulator element 21. In these cooking programs T, the control unit 100 is electrically connected with the electromagnetic valve 50, and therefore controls it. Depending on the temperature signals sent by the temperature sensor 60 to the control unit and depending on the temperature T corresponding to the cooking program T, the control unit 100 will send electrical signals to the electromagnetic valve 50 for the closure thereof, or it will stop sending the electrical signal for the opening thereof. Therefore, the gas burner 10 may or may not receive a gas flow rate corresponding to the angular position of the selected cooking program T, and therefore to the corresponding position of the regulator element 21.

In a first configuration of cooking programs shown in FIG. 5, the program selector 70 comprises six cooking programs without temperature regulation N1-N6 which are arranged angularly in positions with intermediate gas flow in the regulating channel 22 of the regulator element 21. Then, in the turning direction of the regulator element 21, the program selector 70 comprises six cooking programs with temperature regulation T1-T6. The first three cooking programs T1-T3 are arranged angularly in positions with minimum gas flow QMin in the regulating channel 22 of the regulator element 21 and correspond with respective regulating temperatures of 60° C., 70° C. and 80° C., these temperatures being used, for example, for melting chocolate or heating sauces or ready-made foods at 60° C., for foie gras confits or cod confits at 70° C., and for preparing sauces or sterilizing milk or vegetables at 80° C. Furthermore, the other three cooking programs T4-T6 are arranged angularly in positions with maximum gas flow QMax and correspond with respective regulating temperatures of 100° C., 150° C., and 180° C., these temperatures being used, for example, for rice or pasta at 100° C., for fried fish or battered foods at 150° C., and for french fries or tempuras at 180° C. Therefore, the gas flow rates correspond with the temperature level required by the corresponding cooking program T.

In another configuration of cooking programs, shown in FIG. 6, the program selector 70 comprises six cooking programs without temperature regulation N1-N6 which are arranged angularly in positions with intermediate gas flow in the regulating channel 22 of the regulator element 21. Before said cooking programs N1-N6 and after said cooking programs N1-N6, in the range of actuation A of the manual actuator 40, the program selector 70 comprises six cooking programs with temperature regulation T1-T6 which are arranged in the following manner: (i) three of the programs arranged angularly in positions with maximum gas flow QMax before cooking programs N1-N6 in the regulating channel 22 of the regulator element 21, corresponding to cooking programs T1-T3 with respective regulating temperatures of 180° C., 150° C., and 100° C.; and (ii) the other three programs arranged angularly in positions with minimum gas flow QMin corresponding to cooking programs T4-T6 with respective regulating temperatures of 80° C., 70° C. and 60° C. Therefore, the gas flow rates correspond with the temperature level required by the corresponding cooking program T.

Figure 7A:
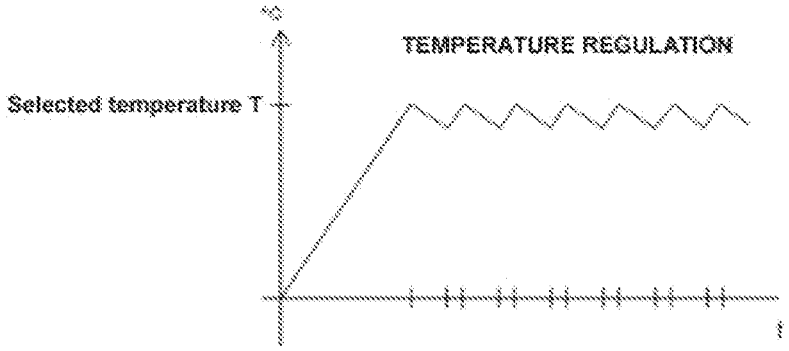
FIG. 7A shows a diagram linking the temperature obtained at a point of the vessel arranged on the burner or in the cooked product, depending on the time elapsed after turning on the flame in the gas burner.
Figure 7B:
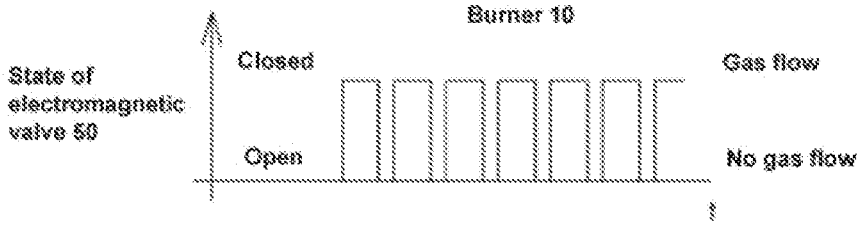
FIG. 7B shows a diagram linking the open or closed state of an electromagnetic valve fluidly communicating the regulating valve and the gas burner, with the time elapsed after turning on the flame in the gas burner.
Figure 7C:
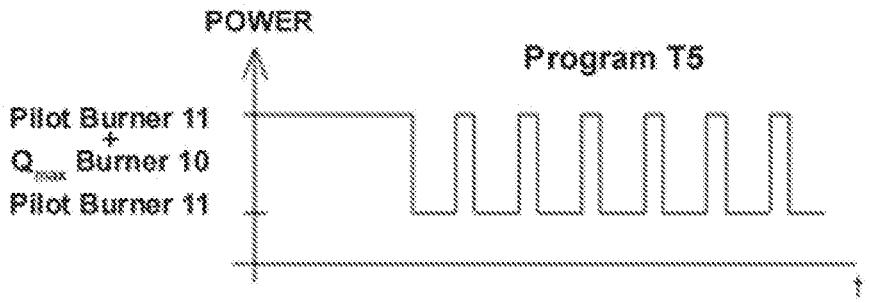
FIG. 7C shows a diagram linking the evolution of the heat power of the gas burner and the pilot burner of the gas cooking appliance of FIG. 1 with respect to the time elapsed after turning on the flame in the gas burner in a cooking program with temperature regulation.
Figure 7D:
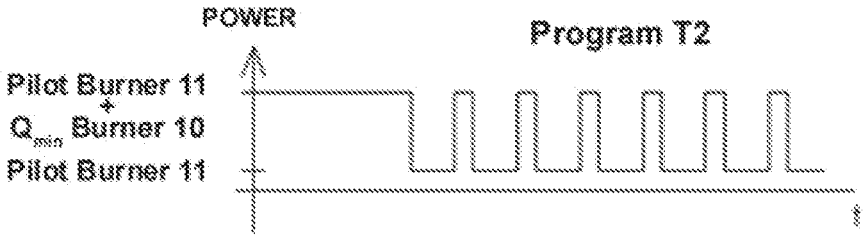
FIG. 7D shows a diagram linking the evolution of the heat power of the gas burner and the pilot burner of the gas cooking appliance of FIG. 1 with respect to the time elapsed after turning on the flame in the gas burner in a second cooking program with temperature regulation.

FIG. 7A shows a diagram linking the temperature T obtained at a point of the vessel 110 arranged on the burner 10 or in the cooked product 120, depending on the time t elapsed after turning on the flame in the gas burner 10. FIG. 7B shows a diagram linking the open or closed state of the electromagnetic valve 50 fluidly communicating the regulating valve 20 and the gas burner 10 with the time t elapsed after turning on the flame in the gas burner 10. FIG. 7C shows a diagram linking the evolution of the heat power of the gas burner 10 and the pilot burner 11 of the gas cooking appliance 200 of FIG. 1 with respect to the time t elapsed after turning on the flame in the gas burner 10 in a cooking program with temperature regulation T5. FIG. 7D shows a diagram linking the evolution of the heat power of the gas burner 10 and the pilot burner 11 of the gas cooking appliance 200 of FIG. 1 with respect to the time t elapsed after turning on the flame in the gas burner 10 in a second cooking program with temperature regulation T2.

As described above, once a cooking program has been defined, in this case with temperature regulation T5 which corresponds with a regulating temperature of 150° C., the gas flow rate in the regulator element 21 corresponds with a maximum gas flow rate QMax. The regulating valve 20 allows the passage of gas to the electromagnetic valve 50, and since cooking program T5 is selected, an electrical signal reaches the control unit 100 which in turn keeps the electromagnetic valve 50 open. The gas therefore reaches the pilot burner 11 through the gas line 25 and the burner 10 through the outlet 24 of the regulating valve 20. The flame in the pilot burner 11, and accordingly the flame in the gas burner 10, is turned on.

In one embodiment, the pilot burner 11 has a heat power of 80 constant watts since the pilot channel 26 keeps a constant gas flow as a result of its shape. The gas burner 10 has a variable heat power since the regulating channel 22 has a shape such that it allows a variable gas flow depending on the angular position within the angle of rotation A. In the angular positions with minimum gas flow QMin, the heat power of the burner 10 is 600 watts, and in the angular positions with maximum gas flow QMax, the heat power of the burner 10 is 3,000 watts. In cooking program T5, the temperature sensed by the temperature sensor 60 of the vessel 110 will increase progressively until reaching the temperature level defined in cooking program T5, which is 150° C. Once an upper threshold level for said temperature in the control unit 100 is exceeded, the control unit 100 sends a signal to the electromagnetic valve 50, which thereby closes. Since there is no flame in the burner 10 and since the vessel 110 is only heated by the pilot burner 11 supplying a low heat power of 80 watts, the vessel 110 cools down. When the temperature reaches a lower threshold level for said temperature in the control unit 100, the control unit 100 stops sending the signal to the electromagnetic valve 50, which thereby opens. The burner 10 already receiving a gas flow turns on with the flame of the pilot burner 11, and the vessel 110 heats up. Progressively over time and while the time of cooking program T5 lasts, the temperature will gradually be regulated.

In the process of regulating the temperature of cooking program T5, the gas passage in the electromagnetic valve 50 is initially open and there is gas flow to the gas burner 10. Every time the temperature reaches the upper threshold level, the gas passage in the electromagnetic valve 50 closes and there is no gas flow to the gas burner 10. Every time the temperature reaches the lower threshold level, the gas passage in the electromagnetic valve 50 opens and there is gas flow to the gas burner 10. In said process of regulating the temperature of cooking program T5, initially, when the gas passage in the electromagnetic valve 50 is open, the heat power corresponds to the sum of the heat powers of the burner 10, corresponding to 3,000 watts in this cooking program, and of the pilot burner 11, corresponding to 80 watts in this cooking program. When the upper threshold level of the selected temperature is reached, the gas passage closes, and only the heat power of the pilot burner 11 exists. When the lower threshold level of the selected temperature is reached, the gas passage opens, and the heat power of the burner 10 is again added to the heat power of the pilot burner 11, and so on and so forth as long as cooking program T5 is underway.

If a cooking program with temperature regulation T2 corresponding with a regulating temperature of 70° C. is defined, for example, the gas flow rate in the regulator element 21 corresponds with a minimum gas flow rate QMin. The regulation of the temperature over time, and the evolution of the state of the electromagnetic valve 50 over time behave similarly as in cooking program T5, with the only difference being that for said selected temperature of 70° C. it will correspond with upper and lower threshold levels corresponding to said temperature which will be defined in the control unit 100. The evolution of the heat power over time will also behave in a similar manner, with the difference being that in this cooking program T2 the gas flow rate reaching the burner 10 is that corresponding to a minimum gas flow rate QMin, so when the gas passage is open and the flame of the burner 10 turned on, the heat power of 80 watts of the pilot burner 11 will be added to the heat power of 600 watts of the burner 10. When the gas passage is closed and the flame of the burner 10 turned off, only the pilot burner 11 is turned on. Since the heat power of the pilot burner 11 is so low, i.e., 80 watts, it does not interfere with the regulation of low temperatures, as is the case in cooking program T2 with a selected temperature of 70° C., since the vessel 110 is only heated with the flame of the pilot burner 11 at those times.

The gas cooking appliance 200 also comprises a thermocouple 80 arranged close to the burner 10, and specifically close to the pilot burner 11, said thermocouple 80 being electrically connected to an electromagnetic valve of the regulating valve 20 (not shown in the drawings). This thermocouple 80 has a safety function because, as a result of the flame of the pilot burner 11, being ON at all times, the electromagnetic valve of the regulating valve 20 is open and the gas flow, where appropriate, is conducted to the electromagnetic valve 50. However, if for any reason the flame in the pilot burner 11 goes out, the electromagnetic valve of the regulating valve 20 closes, the gas flow to the electromagnetic valve 50 being closed.

The gas cooking appliance 200 also comprises a spark igniter 90 arranged close to the burner 10. This spark igniter 90 is electrically connected to the control unit 100, and its function is an alternative to the function of the pilot burner 11, the control unit 100 being what sends ON signals to the spark igniter 90. Since the spark igniter 90 does not generate any heat power, it will not affect cooking programs T with low temperatures either, these programs being those running the greatest risk of temperatures not being regulated. However, every time the electromagnetic valve 50 closes and the burner 10 is turned off, said burner 10 is turned on again with the spark igniter 90.

In this embodiment of the gas cooking appliance 200, the control unit 100 is activated when the manual actuator 40 moves, since it activates an electric switch (not shown in the drawings). The gas cooking appliance 200 also comprises a remote control unit 150, the connection between the control unit 100 and the remote control unit 150 being activated when the manual actuator 40 moves axially. The remote control unit 150 allows monitoring and controlling the gas cooking appliance 200, the connection with the control unit 100 being able to be wired or wireless. The remote control unit 150 can be a smart mobile telephone or a tablet.

The control unit 100 comprises visual and acoustic warning means 130, said warning means 130 alerting the user when one of the temperature sensors 60 does not detect the temperature defined by the cooking program with temperature regulation T selected with the program selector 70. This, for example, may be the case of providing a vessel 110 that is too large for the selected burner 10 or putting too much product 120 to be cooked in the vessel 110.

In a second embodiment of the gas cooking appliance 200, shown in FIG. 2, the operability of this appliance is the same as that described above for the first embodiment of the gas cooking appliance 200. The difference lies in the fact that the burner 10 of this second embodiment comprises two crowns, a central crown 10*a* and an outer crown 10*b*. Gas from a different inlet feeds each of the crowns of the burner 10. Each of these inlets to the crowns 10*a*, 10*b* of the burner 10 are fluidly communicated with a corresponding electromagnetic valve 50*a*, 50. At the same time, these electromagnetic valves 50*a*, 50 are fluidly communicated with a corresponding outlet 24*a*, 24*b* of the regulating valve 20. So, the regulating valve 20 of this second embodiment of the gas cooking appliance 200, comprises a regulator element with two parallel regulating channels (not shown in the drawings) with the same range of actuation.

Figure 9:
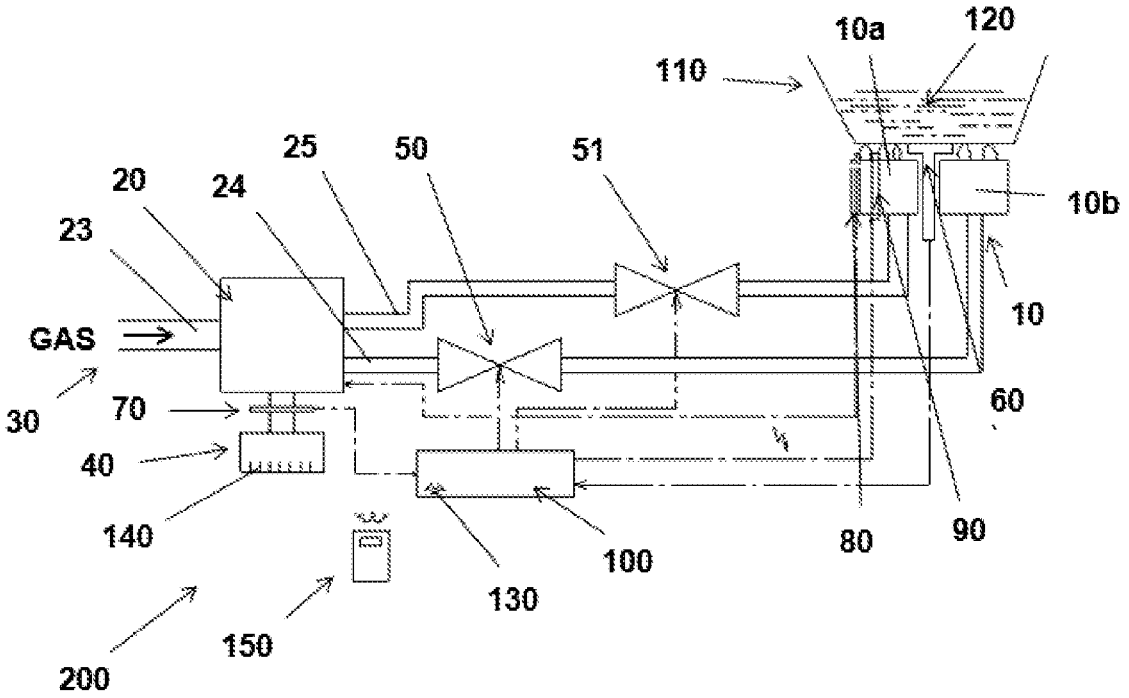
FIG. 9 shows a general outline of a gas cooking appliance according to a third embodiment.

In a third embodiment of the gas cooking appliance 200, shown in FIG. 9, the operability of this appliance is the same as that described above for the second embodiment of the gas cooking appliance 200. The difference lies in the fact that in this third embodiment the pilot burner has been removed and the electromagnetic valve fluidly communicating the regulating valve 20 with the central crown 10*a* is a restrictor type electromagnetic valve 51, instead of being an ON-OFF electromagnetic valve. A restrictor type electromagnetic valve comprises a "closed" position that, instead of totally avoiding the flow of gas, provides a minimum flow of gas, said minimum flow being enough for keeping the flame ON. Therefore, the restrictor type electromagnetic gas valve 51 comprises a first position in which a maximum flow is provided and a second position in which a minimum flow is provided. In this manner, in this embodiment the central crown 10*a* can act as a pilot burner and a pilot burner is not necessary. In this third embodiment the thermocouple 80 is close to the central crown 10*a*.

Figure 10:
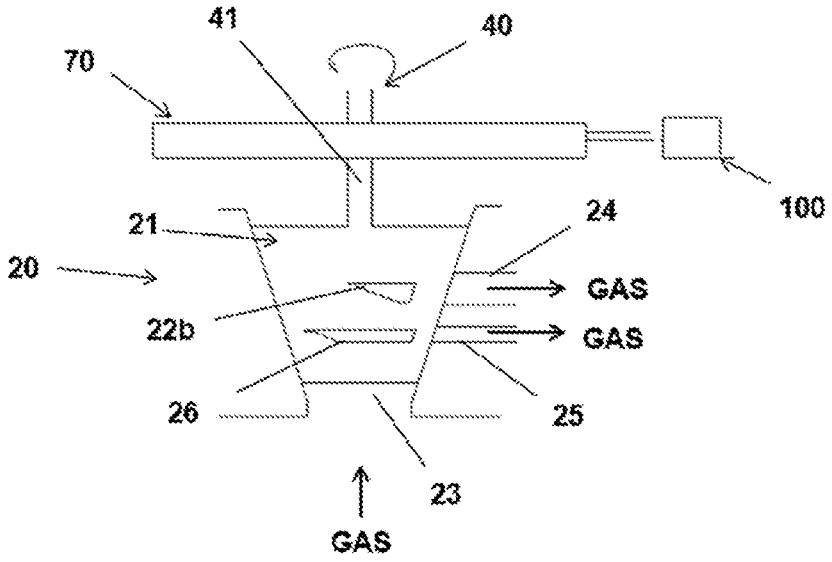
FIG. 10 shows a partial outline of a regulating valve of the gas cooking appliance of FIG. 9, with a program selector coupled thereto, and a regulator element comprising a low-power channel of a central crown of a gas burner, and a regulating channel of an outer crown of the gas burner of the gas cooking appliance.

In this third embodiment, the regulating valve 20 comprises, as shown in FIG. 10, a regulator element 21 with two parallel corresponding channels, a pilot channel 26, and a regulating channel 22*b*, which in this embodiment have different ranges of actuation. In the embodiment of the regulator element 21 shown in FIG. 10, gas flow supply from the pilot channel 26 to the gas line 25 starts in an angular position corresponding to a maximum gas flow QMax, the position being 90°. As the manual actuator 40 is turned further, the gas flow progressively decreases to an intermediate gas flow rate, until a final position being between 225° and 270°, for example. Gas flow supply from the regulating channel 22*b* to the gas outlet 24, starts in an angular position corresponding to a maximum gas flow QMax, the position being 90°, and held until a position being 145°, for example. As the manual actuator 40 is turned further, the gas flow progressively decreases to an intermediate gas flow rate, until a final position being 190°, for example.

Figure 11:
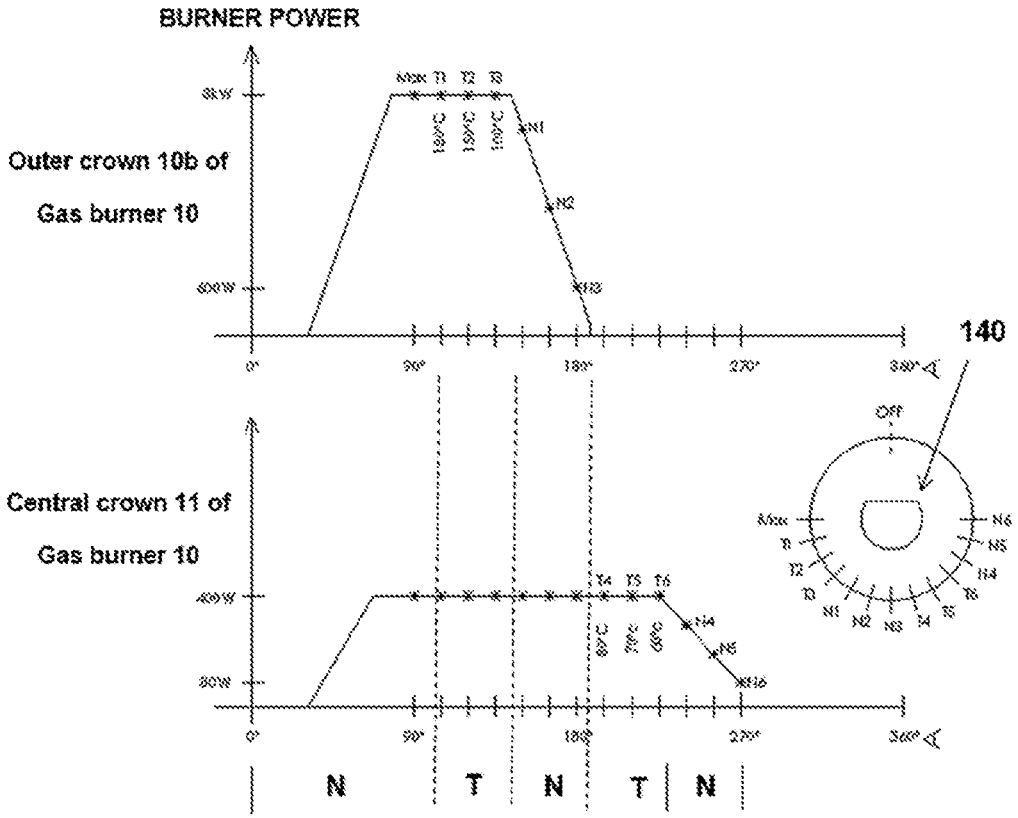
FIG. 11 shows a diagram linking the power of the central crown and the outer crown of the gas burner of the gas cooking appliance of FIG. 9, with the angle of rotation of the regulator element, in one embodiment of the regulator element of the regulating valve, and it shows visual indicators indicating to the user the cooking programs they can select with the program selector.

FIG. 11 shows a diagram linking the power of the central crown 10*a* and the outer crown 10*b* of the gas burner 10 of the gas cooking appliance 200 of FIG. 9, with the angle of rotation of the regulator element 21, in one embodiment of the regulator element 21 of the regulating valve 20, and it shows visual indicators 140 indicating to the user the cooking programs they can select with the program selector 70. In a configuration of the cooking programs, shown in FIG. 11, the program selector 70 comprises six cooking programs without temperature regulation N1-N6 which are arranged angularly in positions, between 145° to 185°, with maximum gas flow, N1-N3, in the low-power channel 26 of the regulator element 21, and in positions, between 230° to 270°, with intermediate gas flow, N4-N6, in the low-power channel 26 of the regulator element 21. The program selector 70 also comprises six cooking programs with temperature regulation T1-T6. The first three cooking programs T1-T3 are arranged angularly in positions between 100° to 145°, with maximum gas flow in the regulating channel 22*b* of the regulator element 21, and correspond with respective regulating temperatures of 180° C., 150° C. and 100° C. Furthermore, the other three cooking programs T4-T6 are arranged angularly in positions between 185° to 230°, with maximum gas flow in the low-power channel 26, and correspond with respective regulating temperatures of 80° C., 70° C., and 60° C., the gas flow rates correspond with the temperature level required by the corresponding cooking program T.

Figure 12:
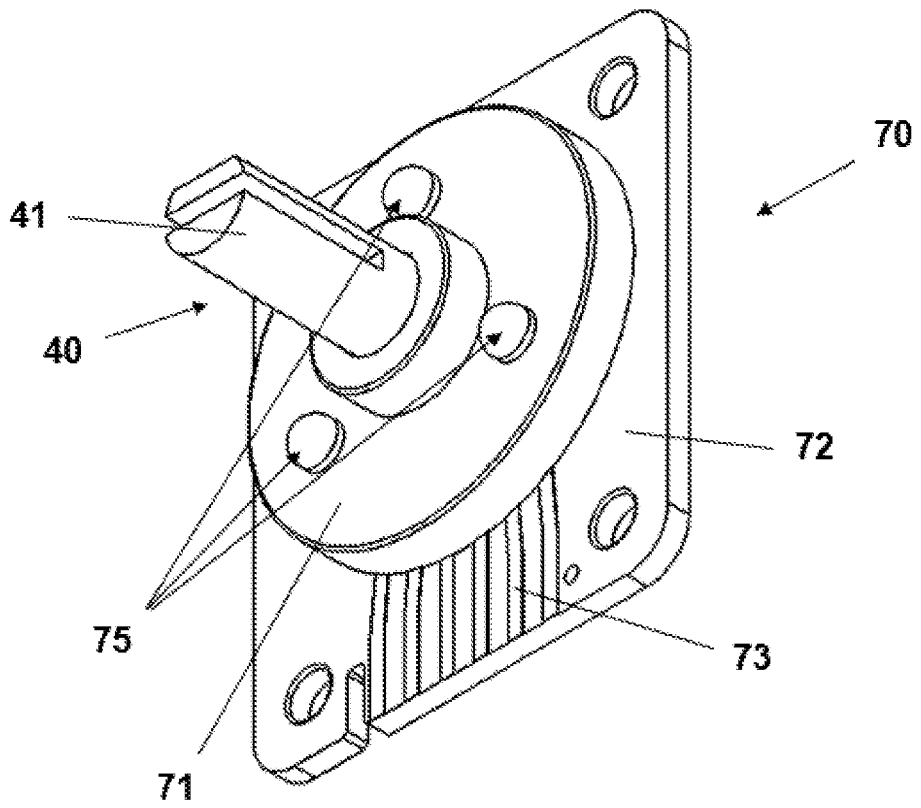
FIG. 12 shows a perspective view of an embodiment of the program selector mechanically coupled to the shaft of the manual actuator of the regulating valve of the gas cooking appliance.

FIG. 12 shows a preferred embodiment of the program selector 70 of the gas cooking appliance 200 of the invention. The program selector 70 comprises lighting means 75 that inform the user about the state of the gas cooking appliance 200 depending on the color and/or intensity and/or the frequency of the light emitted by said lighting means 75. In the preferred embodiment, the lighting means 75 comprise at least one led (three in the embodiment shown in FIG. 12) and a light guide (not shown in FIG. 12) that delimits the contour of the manual actuator 70. FIG. 12 further shows the rotary element 71 mechanically coupled to the shaft 41 of the manual actuator 40 with a conductive end, and the board 72 with different electric circuits 73, by way of tracks, electrically connected with the control unit 100.

The following clauses provide in an unlimited way additional embodiments.

Clause 1: A gas cooking appliance comprising at least one gas burner (10), a manual regulating valve (20) for each gas burner (10) for regulating the gas flow reaching the burner (10) from a gas line (30), said regulating valve (20) comprising a manual actuator (40) movable in a range of actuation (A), the gas flow rate (Q) being changed through the regulating valve (20) when the manual actuator (40) is moved in the range of actuation (A), at least one ON-OFF type electromagnetic gas valve (50) fluidly communicating the regulating valve (20) and the burner (10), a control unit (100) controlling the electromagnetic valve (50), and at least one temperature sensor (60) electrically connected to the control unit (100) to measure a temperature related to a cooking process in the burner (10), a cooking program selector (70) is electrically connected to the control unit (100) and mechanically coupled to the actuator (40), such that when the actuator (40) is moved in the range of actuation (A), each selected cooking program is associated with a specific gas flow rate (Q) supplied by the regulating valve (20), the program selector (70) comprising at least one cooking program with temperature regulation (T) for carrying out the cooking process, the control unit (100) acting on the electromagnetic valve (50) depending on the selected cooking program with temperature regulation (T).

Clause 2: The gas cooking appliance according to clause 1, wherein when the electromagnetic valve (50) is closed, there is no gas flow between the regulating valve (20) and the respective burner (10).

Clause 3: The gas cooking appliance according to clause 1 or 2, wherein the program selector (70) comprises at least one cooking program with temperature regulation (T) in at least one section with minimum gas flow rate (Qmin) supplied by the regulating valve (20) in the range of actuation (A).

Clause 4: The gas cooking appliance according to any of clauses 1 to 3, wherein the program selector (70) comprises at least one cooking program with temperature regulation (T) in at least one section with maximum gas flow rate (QMax) supplied by the regulating valve (20) in the range of actuation (A).

Clause 5: The gas cooking appliance according to any of the preceding clauses, wherein the regulating valve (20) comprises a regulator element (21) coupled to the actuator (40), the regulator element (21) comprising at least one regulating channel (22) suitable for regulating gas flow between an inlet (23) and at least one outlet (24) of the regulating valve (20).

Clause 6: The gas cooking appliance according to clause 5, wherein the regulator element (21) is rotary and the actuator (40) comprises a shaft (41) coupled to said regulator element (21), the range of actuation (A) being an angle of rotation.

Clause 7: The gas cooking appliance according to clause 6, wherein the regulator element (21) moves angularly in a maximum angle of rotation (A0) between an initial position (OFF) without gas flow, and a final position (D) corresponding to a specific gas flow rate (Q), the angle of rotation (A0) being greater than or equal to the range of actuation (A).

Clause 8: The gas cooking appliance according to any of the preceding clauses, comprising a pilot burner (11) arranged close to the burner (10), the regulating valve (20) being fluidly communicated directly with the pilot burner (11) by means of a gas line (25).

Clause 9: The gas cooking appliance according to any of clauses 1 to 7, wherein each burner (10) comprises a central crown (10*a*) and an outer crown (10*b*), one ON-OFF type electromagnetic gas valve (50) fluidly communicating the regulating valve (20) and the outer crown (10*b*) and an additional electromagnetic gas valve communicating the regulating valve (20) and the central crown (10*a*).

Clause 10: The gas cooking appliance according to clause 9, wherein the additional electromagnetic gas valve communicating the regulating valve (20) and the central crown (10*a*) is an ON-OFF type electromagnetic gas valve (50*a*), the gas cooking appliance further comprising a pilot burner (11) arranged close to the burner (10), the regulating valve (20) being fluidly communicated directly with the pilot burner (11) by means of a gas line (25).

Clause 11: The gas cooking appliance according to clause 9, wherein the additional electromagnetic gas valve communicating the regulating valve (20) and the central crown (10*a*) is a restrictor type electromagnetic gas valve (51), the restrictor type electromagnetic gas valve (51) comprising a first position in which a maximum flow is provided and a second position in which a minimum flow is provided.

Clause 12: The gas cooking appliance according to any of the preceding clauses, comprising a thermocouple (80) arranged close to the burner (10), said thermocouple (80) being electrically connected to an electromagnetic valve of the regulating valve (20), and comprising a spark igniter (90) arranged close to the burner (10), said spark igniter (90) being electrically connected to the control unit (100).

Clause 13: The gas cooking appliance according to any of the preceding clauses, wherein the temperature sensor (60) is a thermistor or a sensor with Bluetooth LE technology configured for being thermally connected with a vessel (110) used for cooking, or a probe configured for being thermally connected with a product to be cooked (120).

Clause 14: The gas cooking appliance according to any of the preceding clauses, wherein the control unit (100) is activated when the actuator (40) is moved axially, said control unit (100) allowing connection with a remote control unit (150), the gas cooking appliance (200) being able to be monitored and controlled through said remote control unit (150).

Clause 15: The gas cooking appliance according to any of the preceding clauses, wherein the control unit (100) comprises visual and/or acoustic warning means (130), said warning means (130) alerting the user when the temperature sensor (60) does not detect the temperature defined by the cooking program with temperature regulation (T) selected with the program selector (70).

Clause 16: The gas cooking appliance according to any of the preceding clauses, comprising visual indicators (140) indicating to the user the cooking program with or without temperature regulation (N, T) selected.

Clause 17: The gas cooking appliance according to any of the preceding clauses, wherein the electromagnetic valve (50) is a normally open solenoid valve, such that if the gas cooking appliance (200) is left without electric power, it can be operated manually by acting on the regulating valve (20).

Clause 18: The gas cooking appliance according to any of the preceding clauses, wherein the program selector (70) comprises lighting means (75) that inform the user about the state of the gas cooking appliance (200) depending on the color and/or intensity and/or the frequency of the light emitted by said lighting means (75).

Clause 19: The gas cooking appliance according to the preceding clause, wherein the lighting means (75) comprise at least one led and a light guide that delimits the contour of the manual actuator (70).

What is claimed is:

1. A gas cooking appliance comprising:

a gas burner;

a manual regulating valve having a gas outlet in fluid communication with the gas burner, the manual regulating valve configured to vary a gas flow reaching the gas burner, the manual regulating valve including a manual actuator movable in a range of actuation, when a gas is supplied to the manual regulating valve a gas flow rate through the valve is changed when the manual actuator is moved in the range of actuation;

a first electromagnetic gas valve of the ON-OFF type located in a gas flow path between the gas outlet of the manual regulating valve and the gas burner, when the first electromagnetic gas valve is in an ON position the first electromagnetic gas valve is in an open position communicating the gas outlet of the manual regulating valve with the gas burner, when the first electromagnetic gas valve is in an OFF position the first electromagnetic gas valve is in a closed position preventing or restricting fluid communication between the gas outlet of the manual regulating valve and the gas burner;

a control unit that is configured to control the first electromagnetic gas valve to cause the electromagnetic valve to alternate between the ON position and the OFF position;

a temperature sensor electrically connected to the control unit, the temperature sensor configured to measure a temperature related to a cooking process in the gas burner; and a cooking program selector electrically connected to the control unit and mechanically coupled to the manual actuator of the manual regulating valve, the cooking program selector including a control circuit that is configured to implement a first cooking program associated with a first cooking process of a first temperature when the manual actuator is in a first position in the range of actuation and to implement a second cooking program associated with a second cooking process of a second temperature when the manual actuator is in a second position in the range of actuation, the second position being different than the first position, the first and second cooking programs being respectively associated with a first specific gas flow rate and a second specific gas flow rate supplied by the manual regulating valve, the control unit being configured to act on the first electromagnetic gas valve to cause the first electromagnetic gas valve to alternate between the ON and OFF positions to regulate the first temperature when the first cooking program is implemented and to regulate the second temperature when the second cooking program is implemented.

2. The gas cooking appliance according to claim 1, wherein when the first electromagnetic gas valve is in the OFF position, there is no gas flow between the manual regulating valve and the gas burner.

3. The gas cooking appliance according to claim 1, wherein at least one of the first and second specific gas flow rates is a minimum gas flow rate supplied by the manual regulating valve.

4. The gas cooking appliance according to claim 1, wherein both the first and second specific gas flow rates is a minimum gas flow rate supplied by the manual regulating valve.

5. The gas cooking appliance according to claim 1, wherein at least one of the first and second specific gas flow rates is a maximum gas flow rate supplied by the manual regulating valve.

6. The gas cooking appliance according to claim 1, wherein both the first and second specific gas flow rates is a maximum gas flow rate supplied by the manual regulating valve.

7. The gas cooking appliance according to claim 1, wherein the first temperature is greater than the second temperature with the first specific gas flow rate being a maximum gas flow rate ($Q_{Max}$) supplied by the manual regulating valve and the second specific gas flow rate being a minimum gas flow rate supplied by the manual regulating valve.

8. The gas cooking appliance according to claim 1, wherein when the manual actuator is in a third position in the range of actuation associated with a third specific gas flow rate the control unit is configured to maintain the first electromagnetic valve in the OPEN position with no temperature regulation.

9. The gas cooking appliance according to claim 8, wherein the third specific gas flow rate is the same as at least one of the first and second specific gas flow rates.

10. The gas cooking appliance according to claim 9, wherein the third specific gas flow rate and the at least one of the first and second specific gas flow rates is a maximum gas flow rate supplied by the manual regulating valve.

11. The gas cooking appliance according to claim 9, wherein the third specific gas flow rate and the at least one of the first and second specific gas flow rates is a minimum gas flow rate supplied by the manual regulating valve.

12. The gas cooking appliance according to claim 1, wherein the manual regulating valve comprises a regulator element coupled to the manual actuator, the regulator element including at least one regulating channel suitable for regulating gas flow between an inlet and the outlet of the manual regulating valve.

13. The gas cooking appliance according to claim 12, wherein the regulator element is rotary and the manual actuator comprises a shaft coupled to regulator element, the range of actuation being an angle of rotation.

14. The gas cooking appliance according to claim 13, wherein the regulator element moves angularly in a maximum angle of rotation between an initial OFF position without gas flow, and a final position corresponding to a specific gas flow rate, the angle of rotation being greater than or equal to the range of actuation.

15. The gas cooking appliance according to claim 14, further comprising a pilot burner arranged close to the gas burner, a gas flow to the pilot burner being supplied through the manual regulating valve only in the range of actuation.

16. The gas cooking appliance according to claim 1, further comprising a pilot burner arranged close to the gas burner, a gas flow to the pilot burner being supplied through the manual regulating valve which is fluidly communicated directly with the pilot burner.

17. The gas cooking appliance according to claim 1, further comprising a second electromagnetic gas valve, the gas burner including a central crown and an outer crown, the first electromagnetic gas valve being positioned in a first gas flow path between the manual regulating valve and the outer crown of the gas burner, the second electromagnetic gas valve being positioned in a second gas flow path between the manual regulating valve and the central crown of the gas burner.

18. The gas cooking appliance according to claim 17, further comprising a pilot burner arranged close to the gas burner, a gas flow to the pilot burner being supplied through the manual regulating valve which is fluidly communicated directly with the pilot burner.

19. The gas cooking appliance according to claim 17, wherein the second electromagnetic gas valve is a restrictor type electromagnetic gas valve, the restrictor type electromagnetic gas valve comprising a first position in which a maximum gas flow is provided and a second position in which a minimum gas flow is provided.

20. The gas cooking appliance according to claim 1, further comprising a thermocouple and a spark igniter, the thermocouple being located close to the gas burner and being electrically connected to the first electromagnetic gas valve, the spark igniter also being located close to the gas burner and being electrically connected to the control unit.

21. The gas cooking appliance according to claim 1, wherein the temperature sensor is configured for being thermally connected with a vessel used for cooking.

22. The gas cooking appliance according to claim 1, wherein the temperature sensor is a probe configured for being thermally connected with a product to be cooked.

* * * * *